US009318083B2

(12) United States Patent
Cacciolo, Jr.

(10) Patent No.: US 9,318,083 B2
(45) Date of Patent: Apr. 19, 2016

(54) DRUMSTICK

(71) Applicant: Thino P Cacciolo, Jr., Freehold, NJ (US)

(72) Inventor: Thino P Cacciolo, Jr., Freehold, NJ (US)

( * ) Notice: Subject to any disclaimer, the term of this patent is extended or adjusted under 35 U.S.C. 154(b) by 0 days.

(21) Appl. No.: 14/629,720

(22) Filed: Feb. 24, 2015

(65) Prior Publication Data

US 2015/0170621 A1 Jun. 18, 2015

Related U.S. Application Data

(63) Continuation-in-part of application No. PCT/US2014/043355, filed on Jun. 20, 2014.

(60) Provisional application No. 61/837,388, filed on Jun. 20, 2013.

(51) Int. Cl.
*G10D 13/02* (2006.01)
*G10D 13/00* (2006.01)

(52) U.S. Cl.
CPC ..... *G10D 13/003* (2013.01)

(58) Field of Classification Search
USPC ..... 84/422.4
See application file for complete search history.

(56) References Cited

U.S. PATENT DOCUMENTS 3,137,194 A * 6/1964 Simpson, Jr. ..... G10D 13/003 473/206
3,730,570 A * 5/1973 Brochstein ..... G10D 13/003 403/361
3,958,485 A * 5/1976 Peters ..... G10D 13/003 84/422.4
4,476,768 A * 10/1984 Willis ..... G10D 13/003 84/422.4
4,719,836 A * 1/1988 Baumgart ..... 84/422.4
4,905,566 A * 3/1990 Hughlett ..... G10D 13/003 84/422.4
5,280,743 A * 1/1994 Abel ..... G10D 13/003 362/102
5,581,031 A * 12/1996 Blankenship, Jr. .. G10D 13/003 84/422.4
6,069,308 A * 5/2000 Rabb ..... G10D 13/06 446/397
7,557,286 B2 * 7/2009 Capotosto ..... A63B 15/00 482/109
7,649,133 B2 * 1/2010 Lento ..... G10D 13/003 84/422.4
8,163,989 B2 * 4/2012 Richard ..... G10D 13/003 84/422.4
2008/0184867 A1 * 8/2008 Davis et al. ..... 84/422.4
2012/0073422 A1 * 3/2012 Ruttenberg ..... G10D 13/003 84/422.4
2014/0069259 A1 * 3/2014 Liao ..... 84/422.4

* cited by examiner

*Primary Examiner* — Christopher Uhlir

(57) ABSTRACT

An improved drumstick is formed from a tip, shaft, and butt, the shaft having a lateral surface. The lateral surface can receive a primary fulcrum groove, which assists a drummer in holding and utilizing the drumstick. To assist with grip and improve ergonomics, an additional secondary fulcrum groove may be provided halfway around the shaft from the primary fulcrum groove. Auxiliary finger grooves can be provided along the shaft as well. To adjust the weight and provide alternate striking surfaces, receptacles and weighted inserts are incorporated into the shaft, the tip, or both. The improved drumstick can be used to help create a personalized drumstick by allowing a drummer to experiment with weight distribution and groove placements until finding one that is ideal.

12 Claims, 8 Drawing Sheets

DRUMSTICK

The current application is a continuation in part of PCT Application PCT/US14/43355 filed Jun. 20, 2014, which claims benefit of U.S. Provisional Patent Application 61/837,388 filed Jun. 20, 2013.

FIELD OF THE INVENTION

The present invention relates generally to drumsticks with a number of receptacles positioned in an annular body of the stick, which receive weighted inserts. The weighted inserts effectively change the mass of the drumstick. By utilizing different combinations of weighted inserts, a customized weight distribution can be created to address a drummer's personal preference. Furthermore, grooves can be carved into the fulcrum points, providing a more efficient and ergonomic grip for a drummer. In addition, the present invention allows for additional grooves to be carved into the drumsticks in order to provide a more customized grip. The customized grip, fulcrum grooves, and combination(s) of weighted inserts are is individual to a drummer's personalized specifications.

BACKGROUND OF THE INVENTION

Playing drums is a very physically demanding activity. As the drummer strikes the drum the opposite force exerted on the drumstick travels in the form of vibration up into the users hands and arms and depending on where the drumstick is held that force can vary. These impacts often result in the drumstick shifting in the drummer's hand. As a result, a drummer may end up holding the drumstick in a less than optimal position due to the movement of the drumstick during playing. Ideally, a drumstick would provide an ergonomic grip to better support a drummer's hands and maintain the correct grip even during intense playing. It is also desirable for the drumstick to have its mass weight distributed (i.e. "be weighted") to a drummer's personal preference. However, similar to fingerprints, each drummer has an individual grip, style, and mass weight distribution preference, such that providing a one-size-fits-all solution is impractical. Therefore, in addition to the need for an improved ergonomic drumstick, there exists a need to better allow drummers to customize drumsticks to their personal preference in order to account for physical variations in anatomy, grip, style of play, tilt of drums and cymbals, height of drum seat and number of drums from drummer to drummer.

Therefore, the objective of the present invention is to provide an ergonomic and comfortable drumstick with customizable grip which uses grooves, weighted inserts, or both for helping to position and support fingers and other strategic parts of the hand in the correct location on the drumstick. The fulcrum point is the support about which a lever pivots, and in the case of a drumstick it provides the optimal and most natural rebound when the tip of the drumstick strikes the drum head. The fulcrum point provides a natural movement which can greatly reduce fatigue and increase performance for drummers, potentially translating into better technique or faster drumming speed.

DETAIL DESCRIPTIONS OF THE INVENTION

All illustrations of the drawings are for the purpose of describing selected versions of the present invention and are not intended to limit the scope of the present invention.

The present invention is an ergonomic drumstick with grooves to improve the playing experience for a drummer. The present invention also provides a means for adjusting the weight of the drumstick to suit the personal preferences of different users. The present invention is an improvement upon traditional drumsticks, which could also serve as a great training and re-training tool for both new and experienced drummers. The design of the present invention encourages proper grip, muscle development, muscle memory, and personalized mass distribution.

Figure 1:
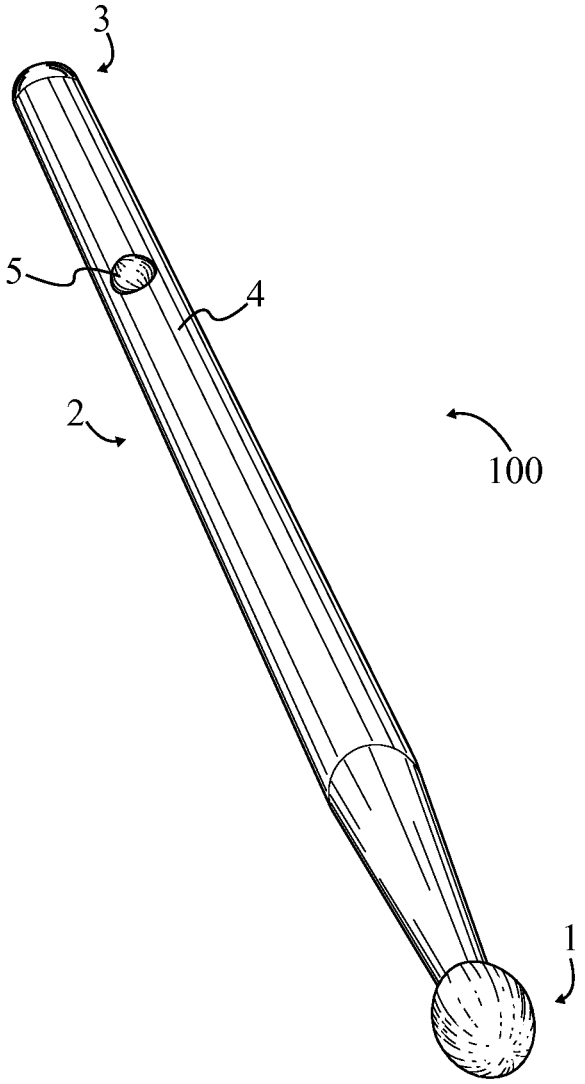
FIG. 1 is a perspective view showing an embodiment of the present invention with only an optional primary fulcrum groove.
Figure 2:
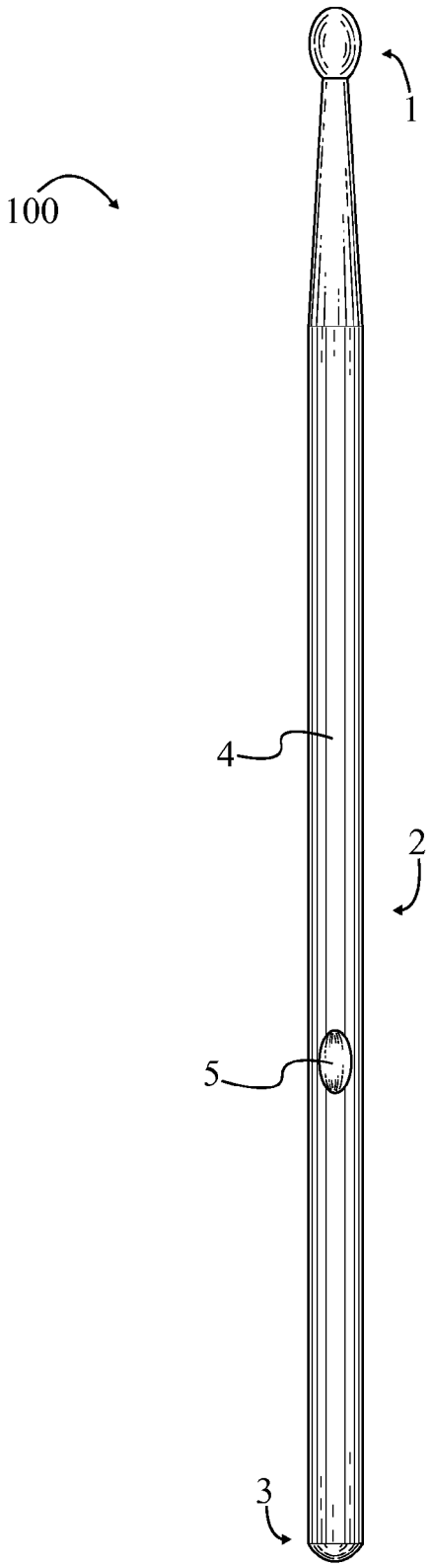
FIG. 2 is a front elevational view showing an embodiment of the present invention with only the optional primary fulcrum groove.

The ergonomic drumstick comprises a drumstick 100 which itself comprises a tip 1, a shaft 2, and a butt 3, the combination of which form the body of the present invention. The tip 1, also known as a head, is connected to the shaft 2. Connected at the other end of the shaft 2, opposite the tip 1, is the butt 3. These three components form the core of the drumstick and serve as the basis for the other components of the present invention. More specifically, the shaft 2 comprises a lateral surface 4 upon which a primary fulcrum groove 5 can be positioned. The primary fulcrum groove 5 is essentially a cavity in the shaft 2; it creates an ergonomic support for a finger by traversing perpendicularly into the lateral surface 4. Ideally, the primary fulcrum groove 5 is shaped to fit a person's finger, having a generally oval shape. The primary fulcrum groove 5 assists with drumming as it makes it easier for a drummer to pivot the drumstick about a finger that is placed in the primary fulcrum groove 5. The drumstick is shown in an embodiment utilizing the primary fulcrum groove 5 via FIG. 1 and FIG. 2.

In order to adjust the balance of the drumstick (a notable advantage of the present invention), a plurality of receptacles 8 and a plurality of weighted inserts 9 may be provided to shift the center of gravity. In one embodiment, the plurality of receptacles 8 are positioned in the shaft 2, traversing through the lateral surface 4 and effectively creates a number of holes in the shaft 2. Preferably, the receptacles 8 intersect a central axis 13 of the drumstick 100, i.e. one that the body of the present invention is revolved around. This alignment ensures that the center of gravity is only translated along one axis (i.e. the central axis 13), rather than multiple axes. If the receptacles 8 do not traverse through the central axis 13 then the center of gravity will be offset in an undesirable manner, detracting from the usability of the present invention. One or more of the receptacles 8 can then be filled with a selected number of weighted inserts 10 from the plurality of weighted inserts 9. Of the plurality of receptacles 8, weighted inserts 9 can be placed into one or more receptacles 8, in any combination up to having all the receptacles 8 filled with a corresponding weighted insert 9. Different combinations will uniquely adjust the center of gravity, helping a user find a center of gravity that is most preferable to them. The weighted inserts 9 themselves can be made of different materials, shapes and sizes creating even more possible combinations and correspondingly a greater variation in potential centers of gravity. It is noted that the receptacles 8 are not limited to being configured in a linear pattern; a second row of receptacles 8 may provided, this additional row being linearly and radially offset from the original row. The offsetting is necessary to ensure that the receptacles 8 of the second row do no intersect with the receptacles 8 of the first row. These receptacles 8 and weighted inserts 9, included the selected number of weighted inserts 10, are shown via FIG. 5, FIG. 6, FIG. 7, and FIG. 8. Ultimately, any number of receptacles 8 and weighted inserts 9 may be provided, with a corresponding increase in possible weight combinations. For example, an embodiment with 9 receptacles has 999,999,999 weight combinations.

In addition to or instead of having the plurality of receptacles 8 being positioned in the shaft 2, one or more receptacles 8 may be placed in the tip 1, with the configuration of the receptacle 8 being dependent on the construction utilized for the present invention. For example, if the tip 1 is separately molded (e.g. as done with a nylon-based tip 1) from the shaft 2 and later connected, the receptacle 8 may be "hidden" within the tip 1. In such an embodiment, the tip 1 and the shaft 2 each comprise a contact face 14, with the two parts being joined by their contact faces 14. Prior to connecting the two parts, a weighted insert 9 is placed in a preexisting cavity of the tip 1 that acts as the receptacle 8 As with the plurality of receptacles 8 and weighted inserts 9 that are placed in the shaft 2, the weighted insert 9 in the tip 1 should be centered on the central axis 13 of the drumstick 100, ensuring that the center of gravity remains positioned on the central axis 13. After the weighted insert 9 is placed in the receptacle 8, the contact face 14 of the tip 1 is connected to the contact face 14 of the shaft 2. The contact faces 14 are aligned with each other such that their perimeters are coincident. As a result, a flush connection is created between the tip 1 and the shaft 2. In this manner a weighted insert 9 can be utilized with an embodiment of the present invention made from separately molded parts. This embodiment is shown combined with the previously described embodiment via FIG. 7 and FIG. 8.

In another embodiment, where the present invention is singularly molded (e.g. from a single piece of wood), it is not possible to completely internalize the receptacle 8 as with the aforementioned example of a separately molded embodiment. In this singularly molded embodiment, the receptacle 8 in the tip 1 traverses through the tip 1 along a central axis 13 of the drumstick 100. Once a weighted insert 9 is placed in the receptacle 8, it is sealed in place by a wooden plug. The wooden plug is then sanded down to create a smooth surface. Resultantly, the configuration of the receptacle 8 in the tip 1 minors that of the plurality of receptacles 8 that may be utilized with the shaft 2. As with other embodiments, the receptacle 11 ideally is centered upon a central axis 13 of the drumstick 100 to ensure the weight distribution is not offset in an undesirable manner.

Figure 3:
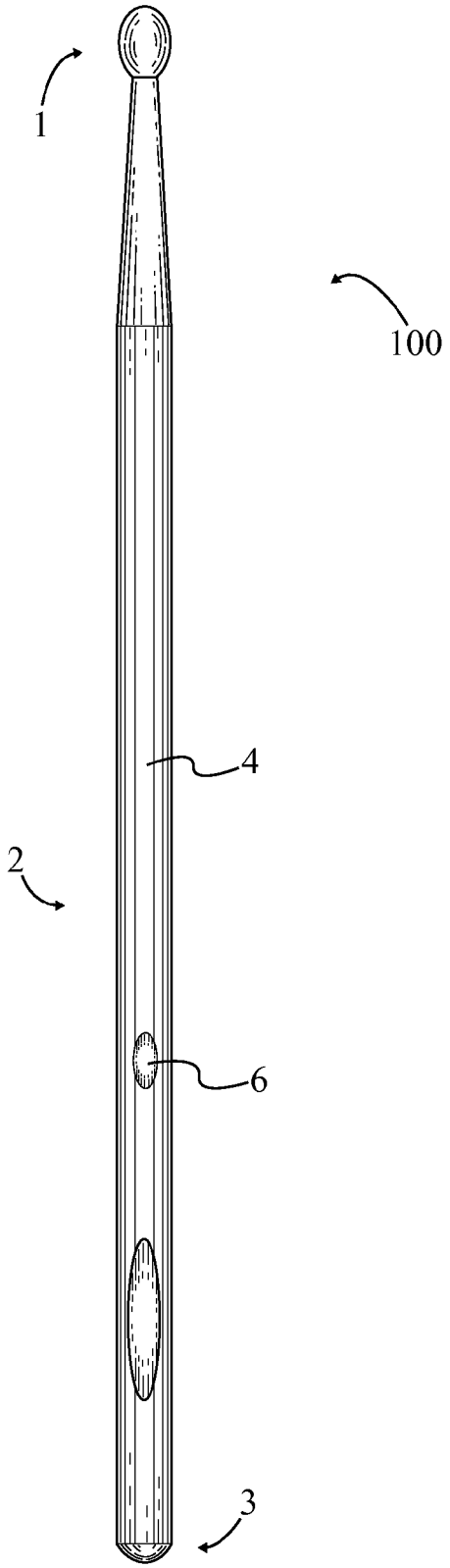
FIG. 3 is a rear elevational view showing an embodiment of the present invention with an optional secondary fulcrum groove and auxiliary groove for a palm.

A number of embodiments are possible for the ergonomic drumstick, utilizing a number of potential combinations of supplemental components. One possibility is the addition of a secondary fulcrum groove 6 which is integrated into the shaft 2. The secondary fulcrum groove 6, similar to the primary fulcrum groove 5, creates an ergonomic imprint on the shaft 2, positioned at a pivot point (i.e. the fulcrum) of the drumstick. The inclusion of the secondary fulcrum groove 6 allows the ergonomic drumstick to more easily be gripped at the fulcrum point. The secondary fulcrum groove 6 is positioned opposite the primary fulcrum groove 5 around the lateral surface 4. The result is that an arc of 180 degrees separates the primary fulcrum groove 5 and secondary fulcrum groove 6. An embodiment that uses the secondary fulcrum groove 6 along with the primary fulcrum groove 5 is referred to as a "double fulcrum groove" embodiment, compared to a "single fulcrum groove" embodiment which only comprises the primary fulcrum groove 5. The secondary fulcrum groove 6, along with a potential palm support, is shown in the rear view of the drumstick in FIG. 3.

Figure 4:
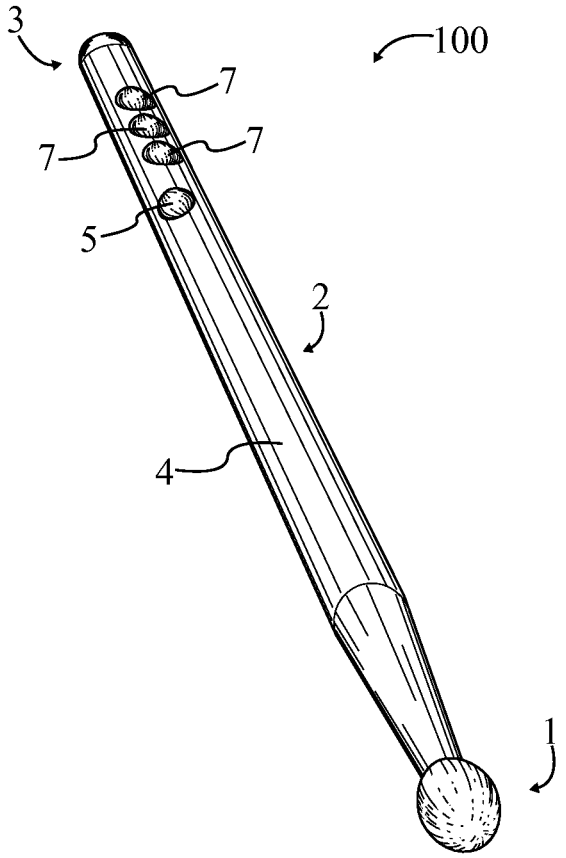
FIG. 4 a perspective view showing an embodiment of the present invention with an optional primary fulcrum groove and optional plurality of auxiliary finger grooves.
Figure 5:
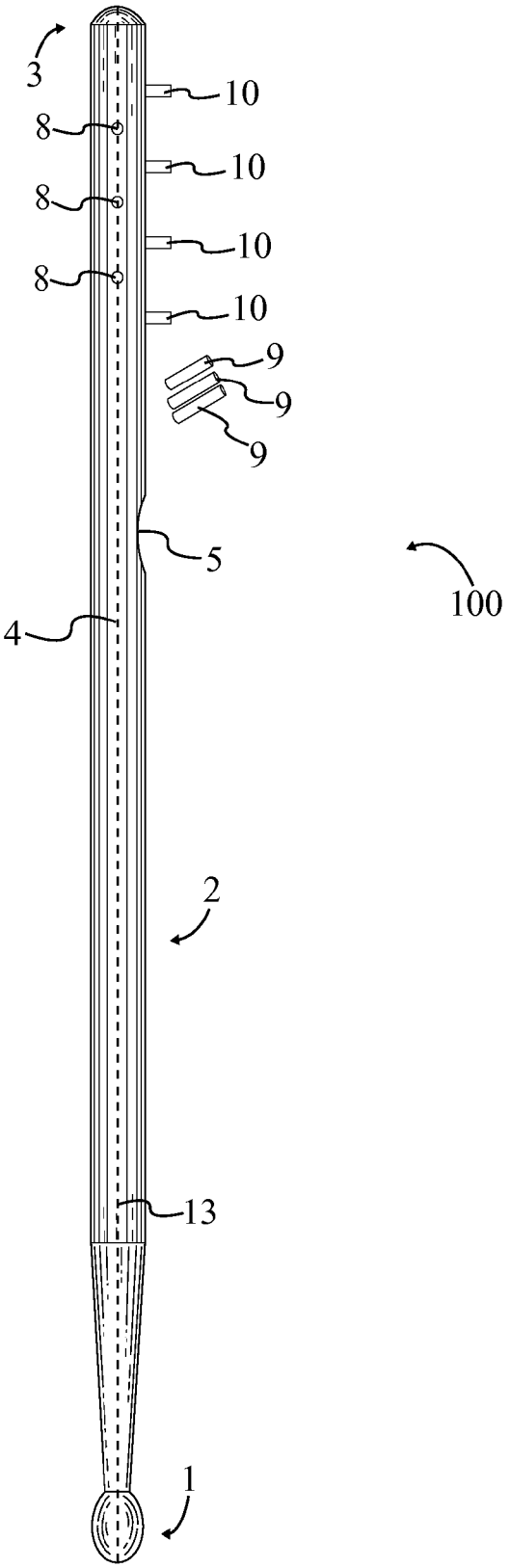
FIG. 5 is a side elevational view showing receptacles and weighted inserts for a shaft of the present invention.
Figure 6:
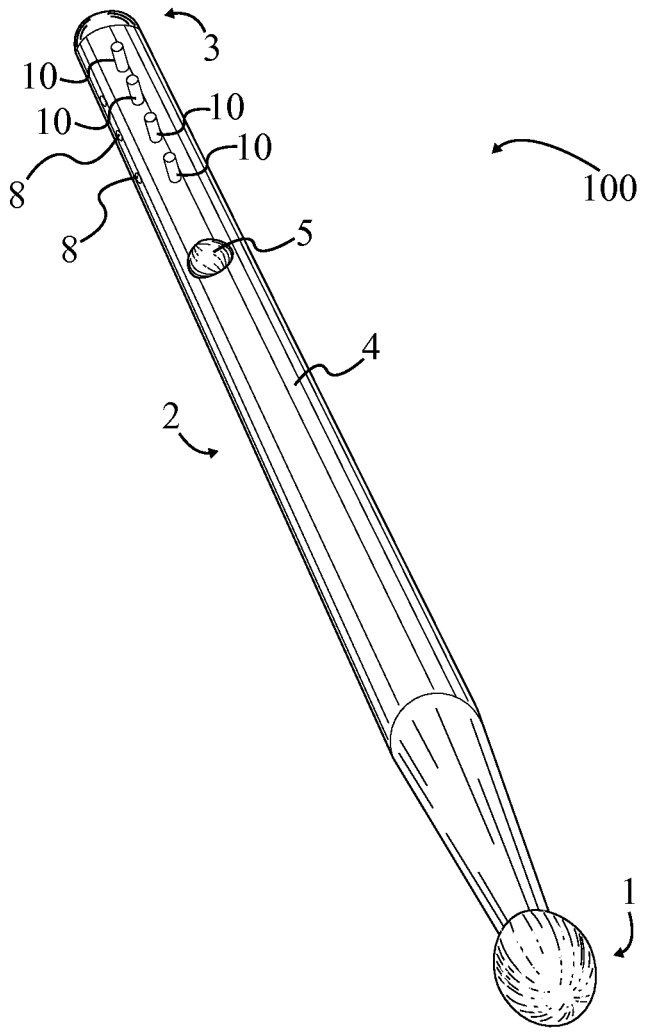
FIG. 6 a perspective view showing the receptacles and weighted inserts of the present invention.
Figure 7:
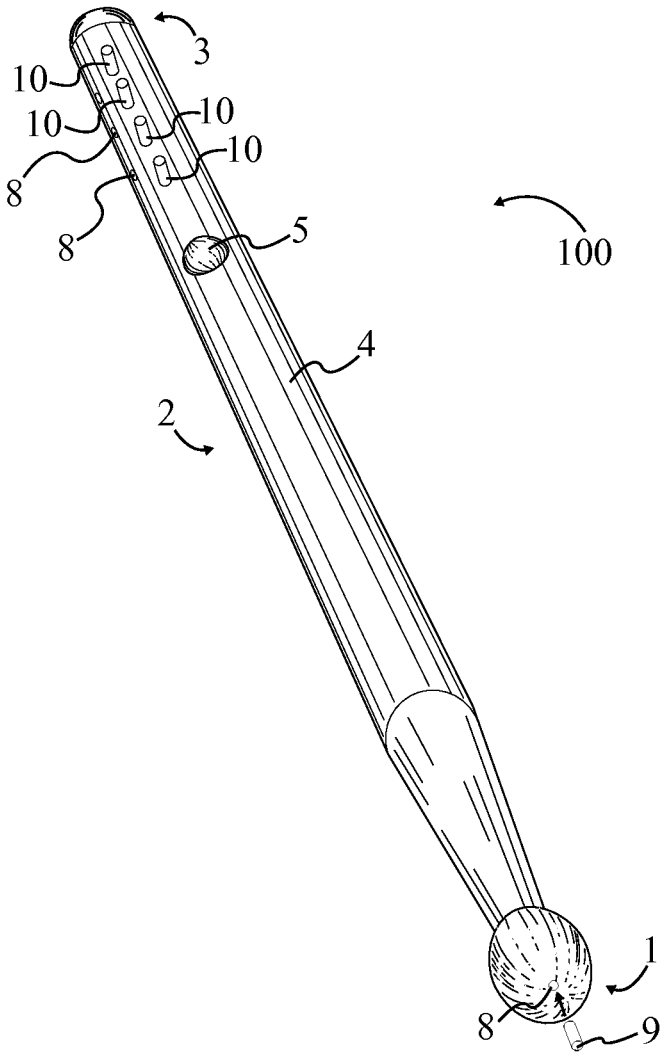
FIG. 7 a perspective view showing an integrally formed tip and corresponding receptacle and weighted insert of the present invention.
Figure 8:
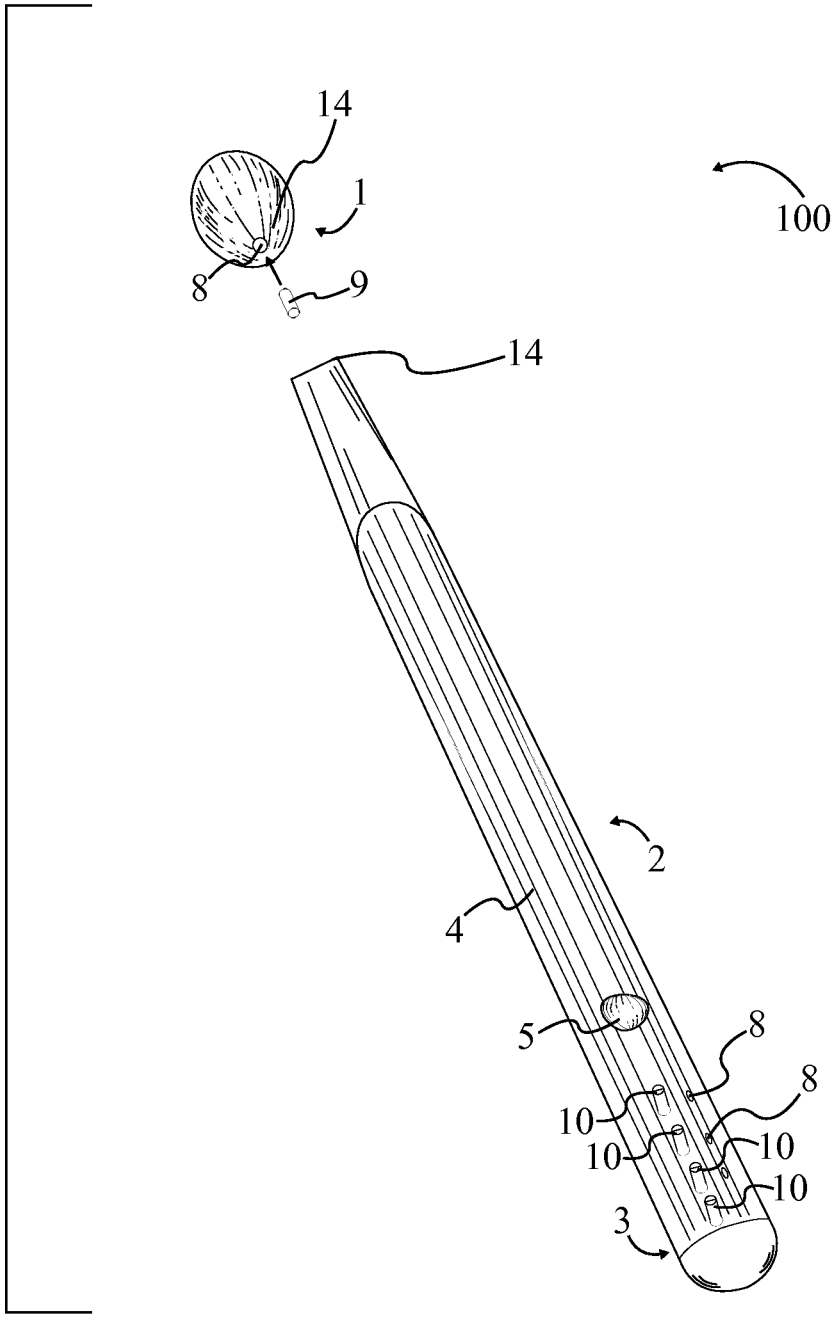
FIG. 8 an exploded perspective view showing a separately molded tip and concealed receptacle and weighted insert of the present invention.

In addition to the fulcrum grooves, the present invention may utilize a plurality of auxiliary finger grooves 7. The plurality of auxiliary finger grooves 7 is compatible with both the single fulcrum groove embodiment and the double fulcrum groove embodiment, though the plurality of auxiliary finger grooves 7 is not required and may be omitted if desired. Each of the plurality of auxiliary finger grooves 7 are similar to the fulcrum grooves in that they traverse perpendicularly into the lateral surface 4, allowing a drummer's fingers to comfortably rest in the corresponding grooves. Commonly, this means at most three auxiliary finger grooves 7 will be provided, supporting the pinky, ring finger, and middle finger. An embodiment utilizing the auxiliary grooves is not restricted to three finger grooves, and embodiments with different numbers of finger grooves are covered within the scope of the present invention. To coincide with common finger placements, the plurality of auxiliary finger grooves 7 is linearly aligned along the lateral surface 4. If the drumstick is being provided for an overhand grip, then the finger grooves 7 are positioned between the primary fulcrum groove 5 and the butt 3. If the drumstick is provided for an underhand grip (as used as part of a traditional grip), the finger grooves 7 are instead positioned between the primary fulcrum groove and the tip 1. These placements allow a drummer to more firmly and comfortably hold a drumstick with all five digits of the hand. The auxiliary finger grooves 7 are shown in FIG. 4.

As thus far described, the present invention can be manufactured in a number of variations, depending on combinations of optional components. Critical to the present invention are the tip 1, the shaft 2, the plurality of receptacles 8, and the plurality of weighted inserts 9. This base version can then be enhanced with the addition of the primary fulcrum groove 5, the secondary fulcrum groove 6, or the plurality of auxiliary finger grooves 7. Variants can include one component from the aforementioned list, multiple components, or all of the components. For example, one variant comprises the primary fulcrum groove 5 in addition to the core components. Another variant comprises the secondary fulcrum groove 6 in addition to the core components. A third variant comprises both the primary fulcrum groove 5 and the secondary fulcrum groove 6 in addition to the core components. These are just a few examples of possible variants; other variants can choose to add other combinations of optional components, producing a bevy of potential embodiments. Further additions that expand or enhance described components of the present invention are also possible. For example, for an overhand grip it may be desirable to provide a large palm groove in the lateral surface 4 next to the primary fulcrum groove 5. Positioned between the primary fulcrum groove 5 and the butt 3, this palm groove would provide an ergonomic support for part of the palm of a user who is employing an overhand grip.

The weighted inserts 9 can be made removable (beneficial for a customization process as later described) or integrated into the body of the drumstick. The weighted inserts 9 may be made from a variety of materials or selected from pre-fabricated items; examples of both include plastics, metals, balls, rods, a variety of different materials or grade of wire, copper coated pellets (such as used with air rifles) and even solder wire. The weighted inserts 9 can be made flush with the lateral surface 4 or, if desired, made to slightly protrude from the lateral surface 4. For example, an embodiment using solder wire as the weighted inserts 9 would drill a hole into the shaft 2 (creating the corresponding receptacle 9) and then place the soldering wire into the created receptacle 9. The soldering wire is reformed by applying heat such as from a soldering iron. The exposed ends of the reformed solder wire are then cut and can then be filed smooth for an ascetic effect or hammered so that they mushroom. As an added advantage, this mushroomed protrusion can be used to strike a drum or cymbal and create a different sound than if the tip 1 of the drumstick were used. The use of the protruding weighted inserts 9 to create different sounds is not limited to versions using mushroomed solder wire; the same concept applies to versions using rods, balls, pellets, and any other materials or items utilized as the weighted inserts 9. These items can be secured in place by a variety of means (e.g. being plugged and glued) that are suitable, as opposed to the solder solution described above.

The weighted inserts 9 can also be exposed or instead either sealed or glued (covered, e.g. via a wood plug) in their respective receptacles 8. Exposed weighted inserts 9 offer an alternative striking surface to a drummer, who can create different sounds by striking a drum, cymbal and other percussion instruments like a cowbell, wood block etc. with the exposed weighted insert 9 instead of the tip of the drumstick as well as create a different ascetic effect. In addition, because a number of materials can be used for the weighted inserts 9, a drumstick with a variety of weighted inserts 9 can be used to create a variety of alternative sounds. A weighted insert 9 placed in a receptacle 8 in the tip 1 likewise creates a different tonal sound compared to a tip 1 without a weighted insert 9, enabling further customization of a drumstick. Potentially, a drumstick could use both exposed and sealed weighted inserts 9 to both adjust mass distribution and provide alternative striking surfaces with different tonal sounds.

The variants of the present invention are beneficial in various applications, one example being drumstick customization and personalization. Due to differences in individual attributes and preferences, there is a demand for drumsticks with different weights and weight distributions. The provision of receptacles 8 and weighted inserts 9 allow the present invention to be used for such customization purposes. By providing a variant of the present invention that has an adjustable mass and weight distribution (thanks to the receptacles 8 and weighted inserts 9), a drummer can experiment with different distributions until finding one that suits their preference. A description of how the present invention and its component grooves, receptacles 8, and weighted inserts 9 can be used as part of a customization process follows.

First, a pair of drumsticks and weights must be provided and tested, whether purchased, borrowed, or otherwise acquired. The pair of drumsticks are provided as a either the single fulcrum groove embodiment, as the variant double fulcrum groove embodiment or one of each, as desired by the potential customer. If the potential customer is happy with the standard issue version of the drumsticks, then they do not need to continue with the customization process. However, if the potential customer desires a different balance, different placement of the fulcrum grooves, or wishes for auxiliary finger grooves 7 to be provided, steps must be taken to determine and record their preference for balance and auxiliary finger groove 7 placement.

Potentially, to streamline the customization process with regards to placement of the fulcrum grooves (whether primary 5 or secondary 6) and auxiliary grooves 7, the customer either can create an account with an associated online storefront, from which a measuring template may be generated and printed. The customer can then place the template on the drumsticks, using this template to indicate where they would like auxiliary finger grooves 7 to be placed, as well as shifting of the primary fulcrum groove 5, the secondary fulcrum groove 6, or both. To assist the customer with marking desired changes, a visual aid may be provided. This visual aid shows the anatomy of the hand, which helps the user mark their grip using anatomical indicators, e.g. fingers, creases, hand segments, radial borders, and ulnar borders. If desired, the customer can also request for ornamental decorations to be printed on the drumstick. This customization streamlining is an optional enhancement and not required to be used with the present invention.

Ideally, the customer is provided with a pair of drumsticks from a setup kit. Each drumstick comprises the plurality of receptacles 8 and the plurality of weighted inserts 9. Additionally, one of the drumsticks is of the single fulcrum embodiment and the other is a double fulcrum embodiment. Such drumsticks allow a customer to experiment with different gross weights and weight distributions in order to find a combination that is best suited to them. Different sets of weighted inserts 9 can made of different materials, with varying unit weights. The sets of weighted inserts 9 are provided with tape to allow a user to temporarily hold the weighted inserts 9 in the receptacles 8. Thus, a user is afforded different combinations of weights to try, increasing the chances of finding a specific weight and weight distribution that is desirable. As an example, a customer might choose to place any number of weighted inserts 9 in receptacles 8 that are closer towards the front of the stick adjacent to the primary fulcrum groove 5, thus greatly shifting the center of gravity towards the front of the stick. A customer might choose to place any number of weighted inserts 9 in receptacles 8 that are closer towards the butt 3 of the stick thus shifting the center of gravity towards the back of the stick. In this manner, a user can test different combinations of weighted inserts 9 and placements in order to adjust both the weight and weight distribution to their personal preference. Once the customer finds an ideal weight via the receptacles 8 and weighted inserts 9, a vendor can use the resulting data to better manufacture a personalized custom drumstick. If a customer would like a more dynamic drumstick, they can request to have a manufacturer add a receptacle 8 in the tip 1, with a corresponding weighted insert 9 placed in the receptacle 8. The customer can also request to leave certain weighted inserts 9 exposed, or to be changed to have different unit weights than the weights of their current drumstick.

The data gathered by the customer is submitted to the vendor in order to allow the vendor to manufacture a drumstick based on said data. The data can be submitted electronically (e.g. via a website) or physically (e.g. through postal mail). Once the vendor has received this information, as well as payment for the modifications, a customized pair of drumsticks will be produced and sent to the customer. The customized pair of drumsticks is personalized to the customer, having been modified based on the submitted customer data. If a user receives their personally customized drumsticks and is still unhappy, they may proceed to engage in further customization, repeating the process of taking measurements of their hand anatomy, adding, removing, or changing the placement of any number or weighted inserts 9, and furthermore submitting the updated information to the website. Similar to having a suit fitted, several adjustments might be required to obtain a perfect fit, but once a perfect fit is achieved the corresponding design can be saved to the customer's profile on the website. By saving the personalized drumstick design to the customer's profile, additional drumsticks may be ordered without the need to engage in the customization process.

The customization process is not limited to the steps outlined in the above description. For example, in real world locations, such as conventions or physical retailers, imprints of a drummer's grip could be taken, such as by a mold, and then used to customize a pair of drumsticks to that drummer's specific grip. The data from these physical imprints could then be uploaded to the web site, allowing for future custom drumstick orders, eliminating the measurement step for these future orders. Another possibility of the customization step is the addition of personalized writing, logos, colors, or any other examples of visual designs that might be desired by the consumer.

Although the invention has been explained in relation to its preferred embodiment, it is to be understood that many other possible modifications and variations can be made without departing from the spirit and scope of the invention as hereinafter claimed.

What is claimed is:

1. A drumstick comprises:
a tip, a shaft, and a butt;
a plurality of receptacles;
a plurality of weighted inserts;
the shaft comprises a lateral surface;
the tip being adjacently connected to the shaft;
the butt being adjacently connected to the shaft, opposite the tip;
the plurality of receptacles being positioned in the drumstick; and
a selected number of weighted inserts being positioned in the plurality of receptacles;
a primary fulcrum groove comprises a primary oval-shaped cavity and integrated into the shaft;
the primary fulcrum groove configured to accept a finger inserted thereto;
the primary fulcrum groove traverses perpendicularly into the lateral surface;
a secondary fulcrum groove comprises a secondary oval-shaped cavity and integrated into the shaft;
the secondary fulcrum groove positioned at a pivot point of the drumstick;
the secondary fulcrum groove being positioned opposite the primary fulcrum groove around the lateral surface;
the secondary fulcrum groove traverses perpendicularly into the lateral surface; and
the primary fulcrum groove being linearly aligned with the plurality of weighted inserts along a length of the shaft.

2. The drumstick as claimed in claim 1 comprises:
the plurality of receptacles being positioned in the shaft;
each of the plurality of receptacles traversing through the lateral surface; and
each of the plurality of receptacles intersecting a central axis of the drumstick.

3. The drumstick as claimed in claim 2 comprises:
the plurality of receptacles being serially positioned along the lateral surface.

4. The drumstick as claimed in claim 1 comprises:
the plurality of receptacles being positioned in the tip.

5. The drumstick as claimed in claim 4 comprises:
the tip and the shaft each comprise a contact face;
the plurality of receptacles traversing perpendicularly into the contact face of the tip;
the contact face of the tip and the contact face of the shaft being adjacently connected to each other;
the contact face of the tip and the contact face of the shaft being perimetrically coincident with each other; and
the plurality of receptacles being centrally positioned in the tip.

6. The drumstick as claimed in claim 4 comprises:
hole traversing into the tip, wherein the tip is integrally formed with the shaft.

7. The drumstick as claimed in claim 4 comprises:
the plurality of receptacles being coincident with a central axis of the drumstick.

8. The drumstick as claimed in claim 1 comprises:
a plurality of auxiliary finger grooves;
the plurality of auxiliary finger grooves being serially positioned along the lateral surface; and
each of the plurality of auxiliary finger grooves traverses perpendicularly into the lateral surface.

9. The drumstick as claimed in claim 8 comprises:
a first group of the plurality of auxiliary finger grooves being positioned between the tip and the primary fulcrum groove, wherein the first group of the plurality of auxiliary finger grooves are configured to support an overhand grip.

10. The drumstick as claimed in claim 9 comprises:
a second group of the plurality of auxiliary finger grooves being positioned between the primary fulcrum groove and the butt, wherein the second group of the plurality of auxiliary finger grooves are configured to support an underhand grip.

11. The drumstick as claimed in claim 1 comprises:
each of the plurality of weighted inserts being exposed, wherein the plurality of weighted inserts are visible.

12. The drumstick as claimed in claim 4 comprises:
a hole traversing into the tip, wherein the tip is made of nylon;
the hole containing a weight; and
the tip secured to the shaft.

* * * * *